US006955351B2

(12) United States Patent
Sueoka

(10) Patent No.: US 6,955,351 B2
(45) Date of Patent: Oct. 18, 2005

(54) PAPER FEEDING DEVICE AND SHEET CARRYING DEVICE

(75) Inventor: Hideki Sueoka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 78 days.

(21) Appl. No.: 10/279,844

(22) Filed: Oct. 25, 2002

(65) Prior Publication Data

US 2003/0090050 A1 May 15, 2003

(30) Foreign Application Priority Data

Nov. 9, 2001 (JP) ..... 2001-343979

(51) Int. Cl.[7] ..... B65H 7/02

(52) U.S. Cl. ..... 271/265.01; 271/264; 271/258.01; 271/259; 271/261; 271/265.02; 271/265.03

(58) Field of Search ..... 271/264, 265.01, 271/265.02, 258.01, 259, 261, 265.03, 242, 245, 246, 220

(56) References Cited

U.S. PATENT DOCUMENTS

| | | | | | |
|---|---|---|---|---|---|
| 998,350 | A | * | 7/1911 | Korzenborn, Jr. | 271/245 |
| 3,516,657 | A | * | 6/1970 | Knudsen | 493/411 |
| 3,781,004 | A | * | 12/1973 | Buddendeck et al. | 271/10.03 |
| 3,888,478 | A | * | 6/1975 | Alderman et al. | 271/8.1 |
| 4,285,511 | A | * | 8/1981 | Abe | 271/178 |
| 4,702,470 | A | * | 10/1987 | Ishii | 271/229 |
| 4,805,893 | A | * | 2/1989 | Kusaka | 271/258.01 |
| 4,883,265 | A | * | 11/1989 | Iida et al. | 271/220 |
| 4,943,174 | A | * | 7/1990 | Eicher | 400/703 |
| 5,005,821 | A | * | 4/1991 | Burger | 271/198 |
| 5,074,545 | A | * | 12/1991 | Handa | 271/227 |
| 5,167,374 | A | * | 12/1992 | Strohmeyer | 241/36 |
| 5,249,793 | A | * | 10/1993 | Scheufler | 271/220 |
| 5,415,387 | A | * | 5/1995 | Suzuki | 271/10.02 |
| 5,473,420 | A | * | 12/1995 | Rizzolo et al. | 399/107 |
| 5,738,349 | A | * | 4/1998 | Shirasaki | 271/242 |
| 6,185,405 | B1 | | 2/2001 | Sueoka | |
| 6,302,606 | B1 | * | 10/2001 | Hayakawa et al. | 400/625 |

FOREIGN PATENT DOCUMENTS

| | | |
|---|---|---|
| JP | 08-23420 | 1/1996 |
| JP | 3121368 | 10/2000 |

* cited by examiner

*Primary Examiner*—Donald P. Walsh
*Assistant Examiner*—Matthew J. Kohner
(74) *Attorney, Agent, or Firm*—Oblon, Spivak, McClelland, Maier & Neustadt, P.C.

(57) ABSTRACT

A paper feeding device comprises a document tray for loading the document, a document-detecting sensor for detecting the document loaded in the document tray and a MYLAR® made of a sheet-shaped resilience material. A part of the MYLAR® is in contact with the document carrying surface at the upstream side of the detecting position of the document-detecting sensor The document is pushed towards the detecting position during the MYLAR® pushing the upper surface of the document. The MYLAR® is bent to form a loop. The lower guide plate is arranged to be in contact with a part of the loop When the document is not detected, the filler of the document-detecting sensor and the MYLAR® overlap each other. A long hole is set in the loop of the MYLAR®.

20 Claims, 10 Drawing Sheets

PAPER FEEDING DEVICE AND SHEET CARRYING DEVICE

CROSS-REFERENCE TO RELATED APPLICATION

This application claims the priority benefit of Japanese application Ser. No. 2001-343979, filed on, Nov. 9, 2001.

BACKGROUND OF THE INVENTION

1. Field of the Invention

This invention relates in general to a paper feeding device and a sheet carrying device wherein the sheet loaded on a carrier plate can be detected and the sheet can be fed towards a predetermined position.

2. Description of Related Art

A conventional paper feeding device comprises a paper-feeding roller, a paper-detecting member and a plate-shaped paper guide. The paper-feeding roller feeds a sheet through a tray loaded with sheets such as documents to be read or stationery etc. The paper-detecting member is arranged at an upstream side in a carrying direction of the paper-feeding roller. The plate-shaped paper guide is set between the paper-detecting member and the paper-feeding roller. Only a small gap exists between the paper guide and the sheet loaded on the tray (Japan Laid-open Publication no. He7-330182).

In an automatic document-feeding device installed in a facsimile or a copier machine, a mechanical type (a filler type) document-detecting sensor is set in a document set portion. The length of the filler depends on the size of the paper-feeding path (the gap which the paper passes through). If the paper-feeding path is large, the filler has to be longer, while if the paper-feeding path is small, the filler has to be shorter. That is because the filler crosses (overlaps) an upper guide plate and a lower guide plate.

Here, referring to FIG. 8A, if the gap between the upper guide plate 11 also serving as a cover and the lower guide plate 12 is large, the thin document 13 will bend towards a home position of the filler of the document-detecting sensor 2 due to a recovery force. As a result, the thin document 13 cannot be detected by the document-detecting sensor 2. This drawback can be overcome by overlapping the filler of the document-detecting sensor 2 and the upper guide plate 11 as shown in FIG. 8B.

However, for loading a plurality of paper on the document setting unit, the paper feed path must be set to be wide enough. Here, referring to FIG. 9A, if there is a gap between the filler of the document-detecting sensor 2 and the upper guide plate 11, if the total height of loaded document 13 is increased, the upmost document 13 may not be detected by the document-detecting sensor 2. On the contrary, referring to FIG. 9B, if the gap between the filler of the document-detecting sensor 2 and the upper guide plate 11 is small, as the upper guide plate 11 is lowered down, the number of sheets of the document 13 for loading must be reduced. Moreover, though it has been considered to extend the filler of document-detecting sensor 2, this will obstruct the operation of the filler so that the layout of the filler cannot be done. For example, if the filler installation space is narrow, it is difficult to extend the filler.

Regarding the technique disclosed in Japan Laid-open publication no. He7-330182 as shown in FIG. 10, a sheet-shaped paper guide (MYLAR®) 14*a* is set at the upstream side in the paper-feeding direction of the filler of the document-detecting sensor 2. The MYLAR® 14*a* actuates the document 13 towards the detecting side of the filler of the document-detecting sensor 2 according to the number of sheets of the document 13.

However, in the conventional paper feeding device, if there is a gap between the sheet-shaped ® 14*a* and the document 13 (for example, fewer number of sheets of the thin document 13 is set), the thin document 13 carried through the gap still cannot be detected by the document-detecting sensor 2. This may delay the thin document 13 from moving to the side of the feeding roller. Moreover, under this condition, the front end of the document 13 will move up and down due to the vibration when the device is driven. The operation for detecting the document 13 is not stable. Additionally, in the structure for holding a pick up roller through a magnetic clutch, one sheet of document 13 is picked up to feed and the magnetic clutch is switched off when the rear end of the document 13 is pulled by the pick up roller. Then the front end of the document 13 to be picked up is free to move up and down. Moreover, to prevent sheets of document 13 from being stacked to be fed, the second document 13 is pushed back by the operation of a one-way clutch. In the structure (separation mechanism) for preventing a double feed, under the condition that the front end of the document 13 is free, the document 13 will be pushed back so much that the detecting operation of the document-detecting sensor 2 is not stable.

Furthermore, during opening or closing the upper guide plate 11 (serving as a cover) of a paper-feeding unit which comprises the pick up roller and the feed roller or during pulling out the document 13 (from the carry position), the front end of the sheet-shaped MYLAR® 14*a* bends backward to the upstream side in the carrying direction. This situation may obstruct the setting of thin paper or the setting of a fewer-sheet document 13.

SUMMARY OF THE INVENTION

To solve these problems, the present invention provides a paper feeding device and a sheet carrying device that can detect if the sheet is set in a predetermined position no matter what the thickness of the paper or the number of sheets of the document is.

According to one aspect of the present invention, a paper feeding device is provided, comprising: a carrier plate for loading a sheet, a detecting means for detecting the sheet loaded on the carrier plate, and a guide means made of a sheet-shaped resilience member A part of the guide means is in contact with a sheet carrying surface at an upstream side of a detecting position of the detecting means, and the guide means guides the sheet towards the detecting position during the guides means pushing an upper surface of the sheet.

With this structure, even with fewer documents loaded by the flexibility and the resilience of the MYLAR®, there is no gap existing between the set document and the front end of the MYLAR®. Therefore, the document will not return to the upstream side in the paper-feeding direction due to the vibration during driving the device or due to the recovery force of the filler of the document-detecting sensor. Especially, when the document-detecting sensor is switched from off to on only by the return of the filler or when the FRR separation mechanism etc. that operates following the return of the next document is set to prevent double feed, the incorrect detecting can be restricted.

According to another aspect of the present invention, the sheet-shaped resilience member is bent into a loop shape, and the sheet carrying surface is in contact with a part of the loop shape.

With this structure, because the sheet such as a document is guided to the filler of the document-detecting sensor such that a part of the loop of the MYLAR® is in contact with the document, the document can be smoothly guided with respect to the document-detecting sensor, and then the shape of the MYLAR® can be stable. Moreover, because the portion in contact with the document is formed in a smooth curve (loop (gradual circular) shape), the setting of the document etc. can be prevented from buckling. Furthermore, due to the resilience of the MYLAR®, even if the contacting position where the loop shape of the MYLAR® is in contact with the carrying surface moves during opening or closing the upper guide plate, or during pulling the document, the position can quickly return to the original contacting position by inserting the next document. Moreover, it is also suitable for the conventional technique, when the guide shape of the MYLAR® imitates the adhesive surface to be in contact with the carrying surface, the MYLAR® is not evenly pushed due the curve of MYLAR®. During opening or closing the upper guide plate (serving as a cover), the front end of the MYLAR® bends backward towards the upstream side in the paper-feeding direction, and then the document can be set.

According to another aspect of the present invention, the detecting means comprise a filler protruding from the sheet carrying surface when the sheet is not detected and retroceding after the filler touches the sheet loaded in the carrier plate. The filler and the guide means overlap each other when the sheet is not detected and a long hole is set in the loop shape of the guide means.

With this structure, the loop of the MYLAR® constructing the guide means is formed into a two-way shape for example. The filler of the document-detecting sensor can be arranged between the two-way shape without touching the loop. Therefore, the MYLAR® and the filler can be prevented from interference, and then the limitation of the layout can be eased to make the device slimmer.

According to another aspect of the present invention, bending claws are set at an end in a longitudinal direction of the guide means to install the guide means onto an upper guide plate oppositely set at an upper side of the sheet carrying surface.

With this structure, there are ear-shaped bending portions (bending claws) and the bending portions can be bent to adhere onto the upper guide plate, and then the drawback that the MYLAR® with a loop shape easily detaches can be overcome. Moreover, if the adhesive surface of the upper guide plate has a rib structure, the angle for adhering can be suitably changed. Therefore, adhering towards the upper guide plate can be possible and the adhesive strength or the bonding strength can be increased.

According to another aspect of the present invention, an installation position of the guide means is at an upstream side in a feed direction of a position such that the guide means is in contact with the sheet carrying surface.

With this structure, when the front end of the loop of the MYLAR® moves towards the upstream side in the paper-feeding direction during opening or closing of the upper guide plate (serving as a cover), the front end of the loop can be quickly changed to move towards the downstream side in the paper-feeding direction by inserting the next document and due to the loop shape and the flexibility of the MYLAR®.

According to another aspect of the present invention, a sheet carrying device is provided, comprising the paper feeding device described as above.

With this structure, the sheet such as a document, which is set at a feeding start position, can be detected no matter what the thickness of the paper or the number of the sheets of the document is, and then the sheet carrying device with a stable feeding operation can be achieved.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

The embodiments of the present invention are explained with the diagrams as follows

Figure 1:
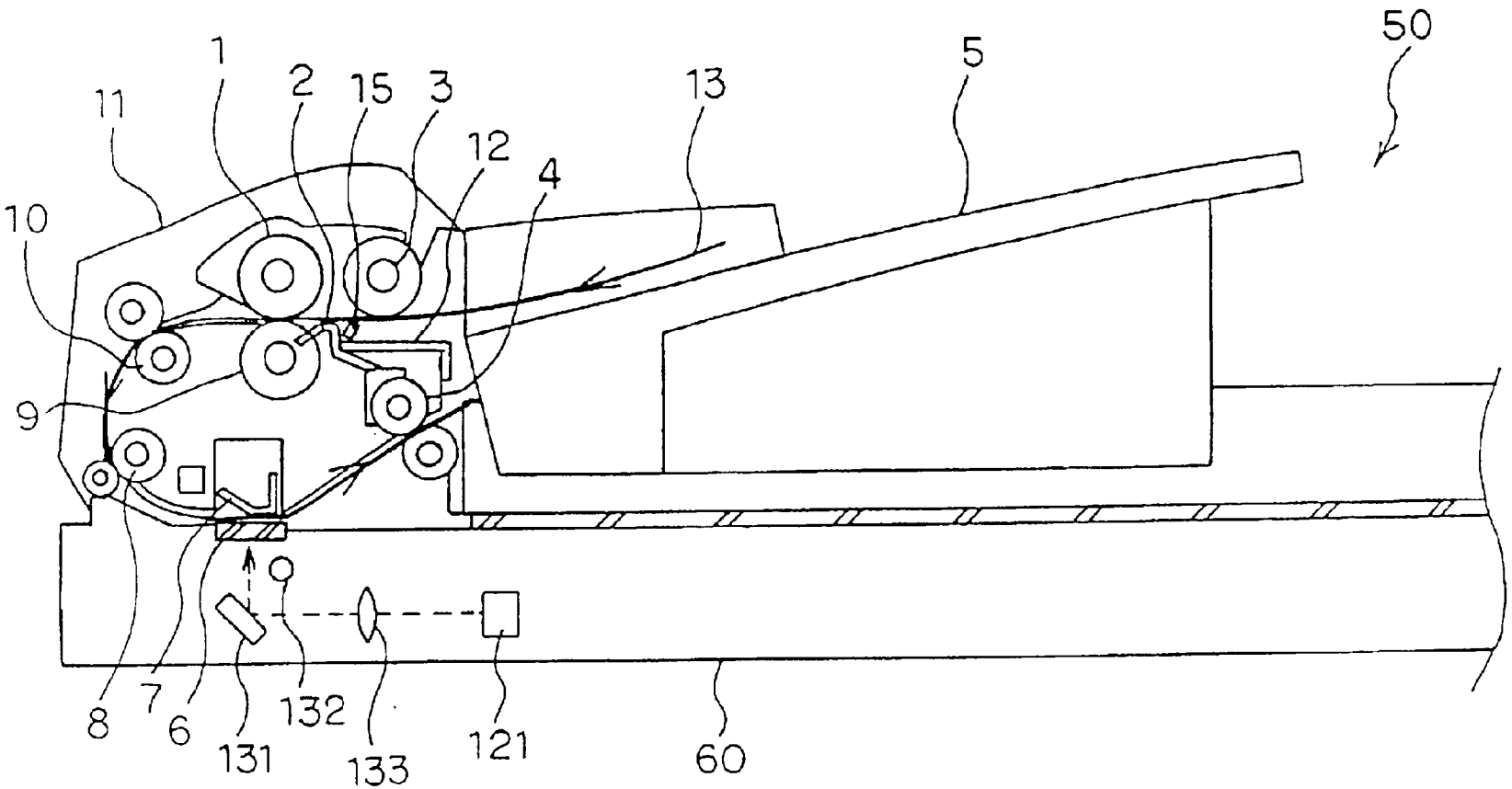
FIG. 1 briefly shows the structure of the image-reading device related to the first embodiment of the present invention.
Figure 3:
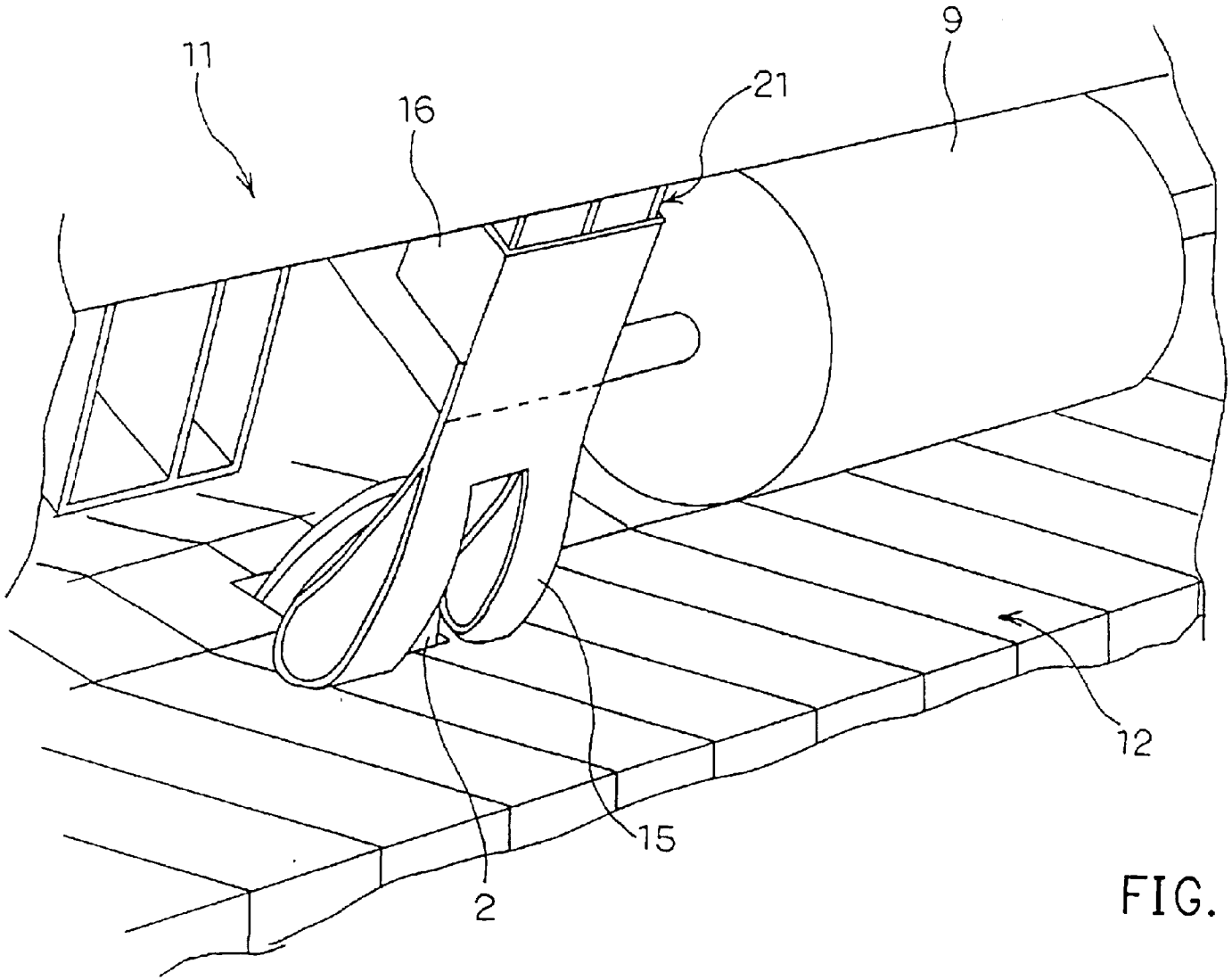
FIG. 3 is a perspective view showing main parts of a paper feeding device related to the first embodiment of the present invention.
Figure 4:
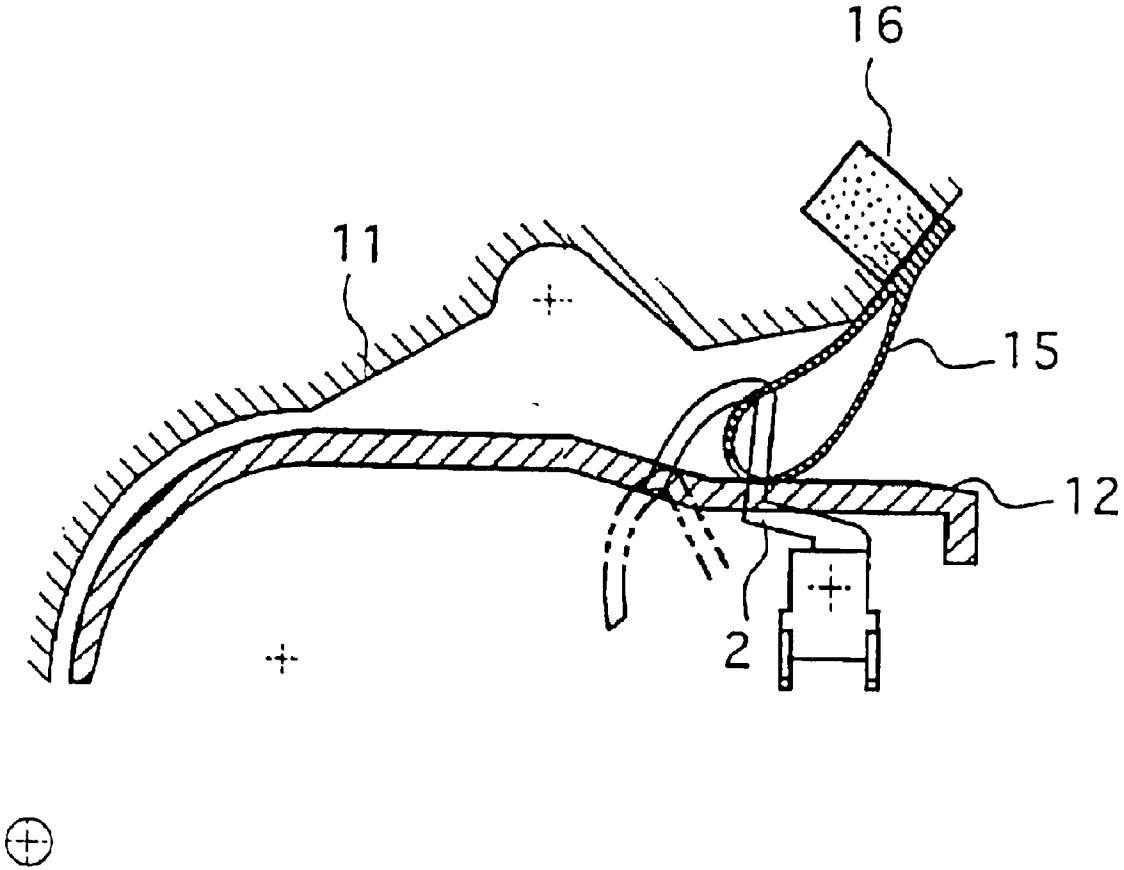
FIG. 4 is a cross-sectional view showing a paper feeding device related to the first embodiment of the present invention.

[The first embodiment] Referring to FIG. 1, a sheet carrying device 50 according to the first embodiment of the present invention comprises a paper feeding device. The paper feeding device (as shown in FIGS. 3 and 4) comprises a document tray 5 for loading a document 13, a document-detecting sensor 2 for detecting the sheet loaded on the document tray 5 and a document guide (MYLAR®) 15. The document guide 15 is made of a sheet-shaped resilience member (the member using PET etc). A part of the document guide 15 is in contact with a document carrying surface in a paper-feeding direction of a detecting position of the document-detecting sensor 2, and the document guide 15 guides the document 13 towards the detecting position when the document guide 15 pushes the upper surface of the document 13.

In FIG. 1, the automatic document-feeding device (ADF, hereinafter) 50 is carried onto the upper portion of the body of the image reading device 60. A reading portion is set on the lower portion of the contact glass 6 of the image reading device 60 for reading the image surface of the sheet-shaped document 13. In this reading portion, the exposure lamp 132 and the first mirror 131 moves left and right in FIG. 1 at the lower side of the contact glass 6 so that the reading portion can read the document 13 (pressure plate mode). Moreover, while the document 13 is being read through the contact glass 6 (automatic carrying mode), the exposure lamp 132 and the first mirror 131 are stopped under the contact glass 6 to read at a reading position (exposure position). It is known that the reflection of the light of the exposure lamp 132 reflected by the document surface is incident to the reading elements 121, such as CCD etc., to form an image thereon by the first mirror 131 or a lens 133.

On the other hand, a separation feeding portion (the paper feeding device) is set in the ADF 50, wherein the separation feeding portion comprises the document tray 5 for loading a document 13, a pick up roller 3 for taking the upmost document 13 loaded on the document tray 5, and a feed roller 1 and a separation roller 9 for constructing a separation mechanism etc. The front end in the paper-feeding direction of the document 13 loaded at a predetermined position on the document tray 5 is detected by the filler type document-detecting sensor 2. Moreover, the document guide (MYLAR®) 15 is set at the upstream side in the paper-feeding direction of the detecting position of the filler of the document-detecting sensor 2 for pushing the document 13 according to its number of sheets. The MYLAR® 15 guides the document 13 inserted into the gap between the upper guide plate 11, which serves as a cover capable of opening and closing, and the lower guide plate 12 to the filler of the document-detecting sensor 2. Furthermore, it is preferred that the location of the document-detecting sensor 2 is within the minimum size in the width direction of the document 13 and is close to the carrying center. Moreover, it is preferred that the location of the document-detecting sensor 2 is between the downstream side in the paper-feeding direction of the pick up position and the upstream side in the paper-feeding direction of the feed roller 1.

Additionally, a carrying portion comprising a first reading roller 10 and a second reading roller 8 etc. is set in ADF 50. The first reading roller 10 pulls the document 13 out of the separation mechanism and carries the document 13 to a resist position. The second reading roller 8 waits for the document 13 at a predetermined position at the upstream side of the reading position in the carrying direction. In a predetermined timing, the document 13 is carried to the reading position. Moreover, a discharging portion which comprises a discharging roller 4 etc. for discharging the read document 13 towards the discharging tray is set in the ADF 50.

Figure 2:
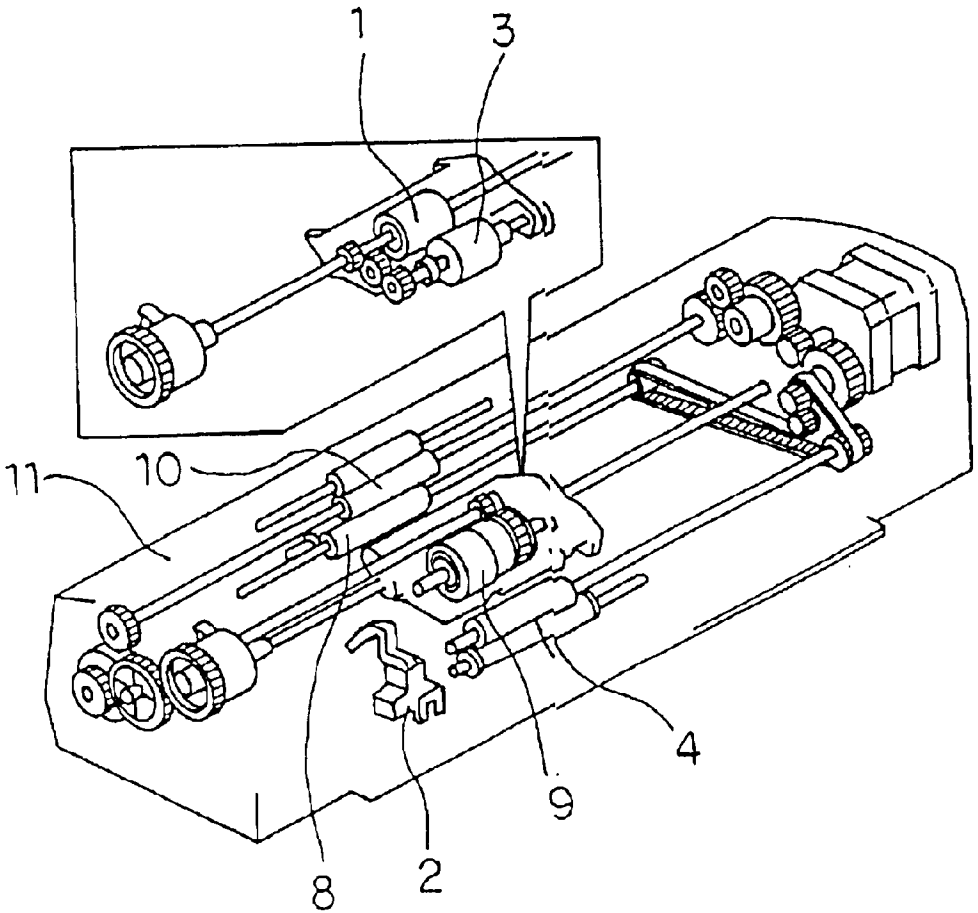
FIG. 2 shows a roller portion of an automatic document-feeding device related to the first embodiment of the present invention.

Moreover, the structure of the roller portion of the ADF 50 is as shown in FIG. 2. Referring to FIG. 2, the feed roller 1, the pick up roller 3 and separation roller 9 integrally form a separation feeding unit. The separation feeding unit is rotatably supported and rotates following the opening or closing of the upper guide plate 11 that serves as a cover. The pick up roller 3 is connected to the feed roller 1 through a timing belt. During separation, the driving of the feeding motor generated from the driving shaft of the feed roller 1 is transferred through the magnetic clutch. The separation roller 9 is rotatably supported onto a central shaft (the driving shaft). The separation roller 9 is driven by a friction through a torque limiter (not shown) having a predetermined torque. If the separation roller 9 is directly engaged with the feed roller 1, or if the separation roller 9 is engaged with the feed roller 1 through one sheet of the document 13, as the feed roller 1 rotates, the separation roller 9 rotates counter-clockwise (CCW). Moreover, the separation roller 9 is set so that its rotation force is smaller than the torque of the torque limiter when two or more sheets of document 13 are between the feed roller 1 and the separation roller 9. In this condition, the separation roller 9 rotates in the original driving direction as clockwise, so the redundant document 13 is pushed back to prevent double feed Additionally, the driving shaft of the separation roller 9 is connected to the motor shaft of the feed roller 1 through gears and the driving force of the separation roller 9 is obtained through the driving of the feed motor.

The roller portion including the separation feeding unit is driven by the ADF controller (not shown). The ADF controller is input with detecting signals created by the document-detecting sensor 2 and other sensors (not shown), state signals created by motors (including the feed motor) for driving each roller etc., and control signals (feed starting signal etc.) output by the body of the image reading device 60. The ADF controller outputs the detecting signals of the document-detecting sensor 2 etc. to the body of the image reading device 60 and the ADF controller controls to drive the feed motor, magnetic clutch and one-rotation clutch etc. according to the controller signals output by the body.

Next, the MYLAR® 15 is explained referring to FIGS. 3 and 4. The MYLAR® 15 made of resilience material such as PET etc. is adhered onto a surface of a rib structure 21 formed on the upper portion of the upper guide plate 11. The lower portion of the MYLAR® 15 is formed in a warp shape. The warp shape is further divided into two ways. Due to the two ways, the warp shape and the filler (the protrusion on the lower guide plate 12 protrudes towards the carry path) of the document-detecting sensor 2 overlap each other Furthermore, a part of the warp shape is in contact with the carrying surface of the lower guide plate 12. The position that the loop shape of the MYLAR® 15 is in contact with the carrying surface is set at the upstream side in the paper-feeding direction of the detecting position of the filler of the document-detecting sensor 2. In FIG. 4, the home position of the filler of the document-detecting sensor 2 is shown as a solid line and the detecting position is shown as a dotted line. As a result, when the loop shape of the MYLAR® 15 is in contact with the carrying surface, the MYLAR® 15 pushes the front end of the document 13 and guides the document 13 towards an insertion direction. Moreover, because the MYLAR® 15 is used, the guide mechanism can be easily and cheaply formed into a loop shape. Furthermore, compared with other rigidity material, the MYLAR® 15 has a small friction and reaction-force with respect to the document 13. Due to the elastic deformation of the loop shape, the MYLAR® 15 can be prevented from damage resulting from contact with the parts of the feeding unit when open and close the upper guide plate 11.

Figure 5A:
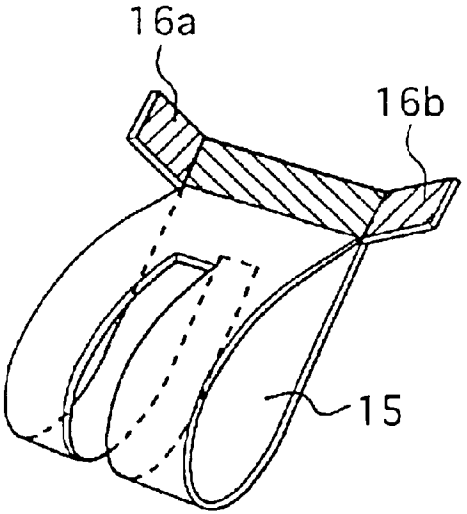
FIGS. 5A, 5B show structures of a MYLAR® related to the first embodiment of the present invention.
Figure 5B:
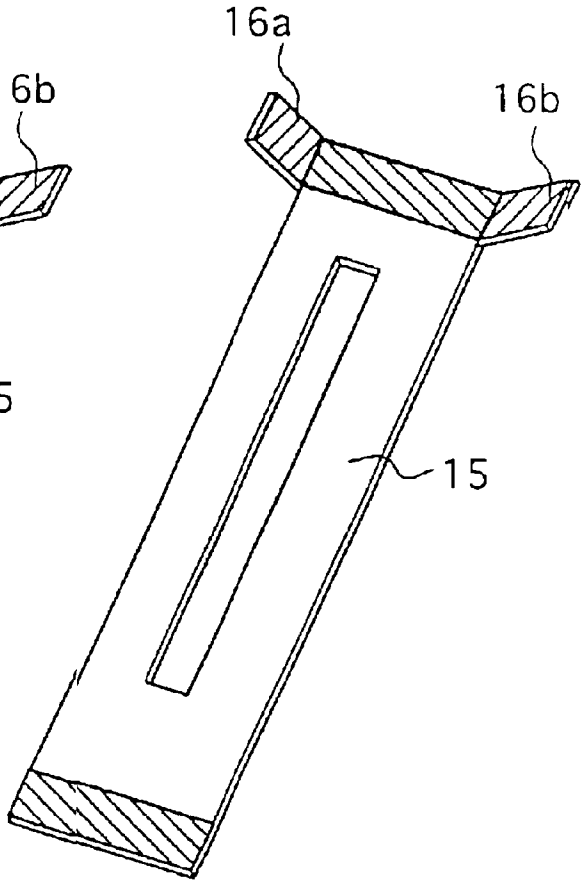

Next, the installation of the MYLAR® 15 is explained with referring to FIGS. 5A, 5B As shown in FIG. 5B, a strip window (long hole) is set on the MYLAR® 15, and the MYLAR® 15 has bending portions (bending claws) 16*a*, 16*b* and adhesion locations (as shown as oblique portions at two ends in longitudinal direction in FIG. 5B) for forming a loop shape There is an adhesive or a bonding-material on the bending portions 16*a*, 16*b*. As a result, when the MYLAR® 15 is to be installed in the separation feeding portion of the ADF 50, first, the two ends are adhered to each other to form a warp shape. Second, the bending portions 16*a*, 16*b* are adhered onto the rib structure 21 of the upper guide plate 11 Here, the adhesive or the bonding-material can be replaced by two-face tape. As a result, because the bending portions 16*a*, 16*b* are designed to be ear-shaped extending towards the longitudinal and vertical directions, the MYLAR® 15 can be restrained from detaching when the MYLAR® 15 is in contact with the inserted document 13 or rubbed due to open or close the upper guide plate 11.

With the structure described above, under the condition that the ADF 50 is lifted-down (automatic carrying mode), the first image surface of the document 13 is set facing-up in the document tray 5. While the front end of the document 13 is being pushed, the front end of the document 13 is inserted in the gap between the lower guide plate 12 and the upper guide plate 11 At this time, the filler of the document-detecting sensor 2 rotates and detects the document 13, and then the detecting information is transferred to the ADF controller (not shown). Here, if the start button (not shown) of the image-reading device 60 is pressed, the ADF controller receives the feeding signal to drive the feeding portion. As a result, each upmost document 13 is supplied onto the contact glass 6 of the reading portion one by one.

When the document 13 is detected by the document-detecting sensor 2 and the start button is pressed down, the document 13 pushed due to the pick up roller 3 is taken from the upmost one by the pick up roller 3, then one sheet of the document 13 will be separated and carried towards the separation mechanism comprising the feed roller 1 and the separation roller 9. Here, for preventing double feed, though the separation roller 9 rotates clockwise to push back the redundant document 13, the MYLAR® 15 pushes the upper surface of the next document 13, and then the redundant document 13 is not pushed back too much Therefore, the detecting of the document-detecting sensor 2 is not led to be incorrect Moreover, the pick up roller 3 is driven through a magnetic clutch. When one sheet of the document 13 is taken out by the driving of the pick up roller 3, the rear end of the document 13 passes through the feed roller 1 to turn off the magnetic clutch, then even if the pick up roller 3 retrocedes from the upper surface of the next document 13, the next document 13 is not raised up resulting from that the upper surface of the next document 13 being pushed by the MYLAR® 15. Therefore, the detecting of the document-detecting sensor 2 is not led to be incorrect. In this way, the separated document 13 is carried to the carrying portion having the first reading roller 10 and the second reading roller 8 Here, a resist sensor (not shown) detects the front end of the document 13 after it has been separated to match the timing that the front end of the document 13 passes through the reading portion of the body of the image reading device 60 and the timing for starting reading image. After a period of feeding the document 13, if the front end of the document 13 does not reach the resist sensor, this state will be judged as a jam. As a result, after the image is read by the reading portion, the document 13 is carried and discharged to a discharging portion having a discharging roller 4 etc. Moreover, because the upper surface of the next document 13 is pushed by the MYLAR® 15, the front end of the document 13 can be restricted to swing up and down due to the vibration during driving the device and the document-detecting operation can be restricted from being unstable With the structure described above, the automatic document-feeding device 50 according to the first embodiment of the present invention comprises the document tray 5 for loading the document 13, the document-detecting sensor 2 for detecting the sheet loaded on a predetermined position in the document tray 5 and the sheet-shaped resilient member Because the automatic document-feeding device 50 further comprises the separation feeding portion in which the MYLAR® 15 is set such that a part of the MYLAR® 15 is in contact with the document carrying surface at the upstream side in the paper-feeding direction of the detecting position of the document-detecting sensor 2 and is set to guide the document 13 to the detecting position during pushing the upper surface of the document 13, no matter how thick the paper is or what the number of sheets of the document is, it can be detected that the document 13 is set at the detecting position of the document-detecting sensor 2

Additionally, because the automatic document-feeding device 50 according to the first embodiment of the present invention comprises the separation paper-feeding portion, wherein a loop is bent to form in the MYLAR® and a part of the loop shape is in contact with the document carrying surface, and the filler of the document-detecting sensor 2 and the MYLAR® overlap each other when the document is not detected, the document 13 can be smoothly guided to the document-detecting sensor 2 and the MYLAR® 15 and the filler of the document-detecting sensor 2 can be prevented from being interfered. Therefore, the limitation for the layout can be eased to make the automatic document-feeding device 50 slimmer.

Figure 6:
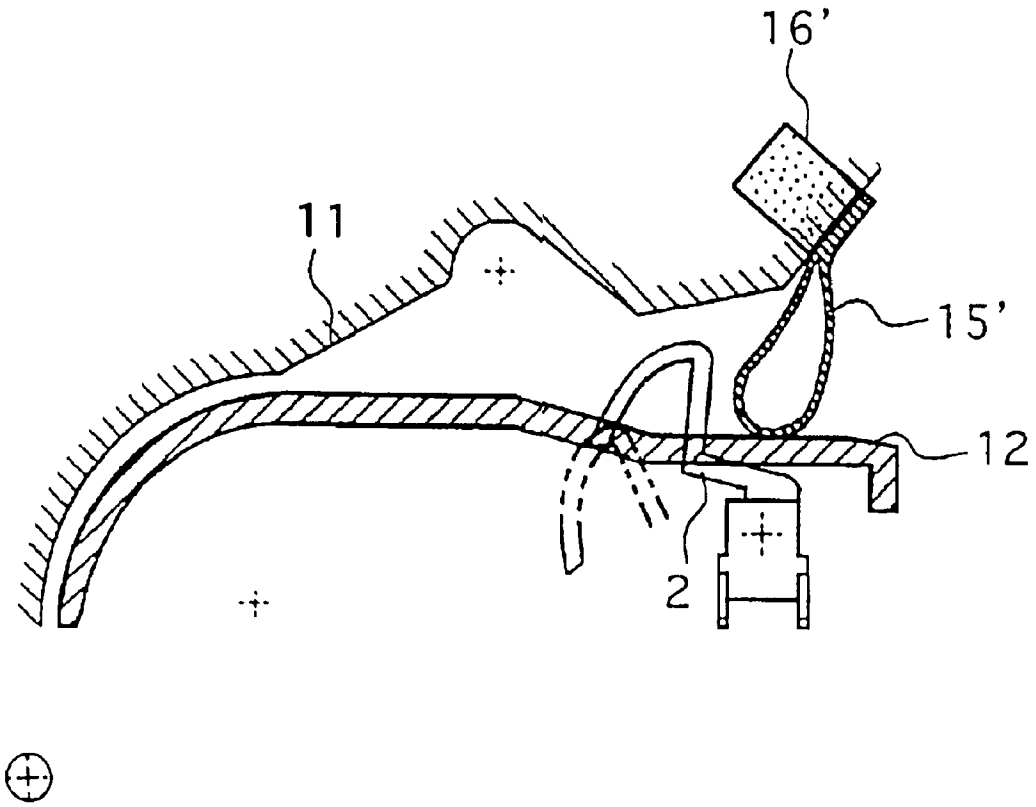
FIG. 6 is a cross-sectional view showing main parts of a paper feeding device related to the second embodiment of the present invention.

[The second embodiment] FIG. 6 is a cross-sectional view showing main parts of the paper feeding device related to the second embodiment of the present invention. It is different from the first embodiment in that the MYLAR® 15' of the paper feeding device set on the automatic document-feeding device (ADF) 50 is bent into a loop and the carrying surface of the document 13 is in contact with a part of the loop shape of the MYLAR® 15', With the structure of the second embodiment, there is no need to set a long hole in the loop shape of the MYLAR® 15', its manufacture is easy The paper feeding device in this embodiment, is set in the ADF 50 of the first embodiment and this ADF 50 is carried on the body of the image reading device 60 as shown in the first embodiment. The whole structure is substantially the same as the first embodiment except the MYLAR® 15'. The same members as shown in FIG. 1 are with the same numerical references and the explanation thereof is omitted. In FIG. 6. the MYLAR® 15' made of resilience material such as PET etc. is adhered onto the rib structure 21 formed on the upper portion of the upper guide plate 11. The lower portion of the MYLAR® 15' is formed into a warp shape. A part of the warp shape is in contact with the carrying surface of the lower guide plate 12 at the upstream side of the detecting position of the filler of the document-detecting sensor 2, i.e. at the upstream side of the position such that the filler of the document-detecting sensor 2 protrudes towards the carrying surface of the lower guide plate 12 (as shown in the filler protrusion in right side in FIG. 6). In FIG. 6, the home position of the filler of the document-detecting sensor 2 is shown as a solid line and the detecting position is shown as a dotted line. As a result, because the loop shape of the MYLAR® 15' is in contact with the carrying surface, the front end of the document 13 is pushed and guided towards the insertion direction.

Figure 7B:
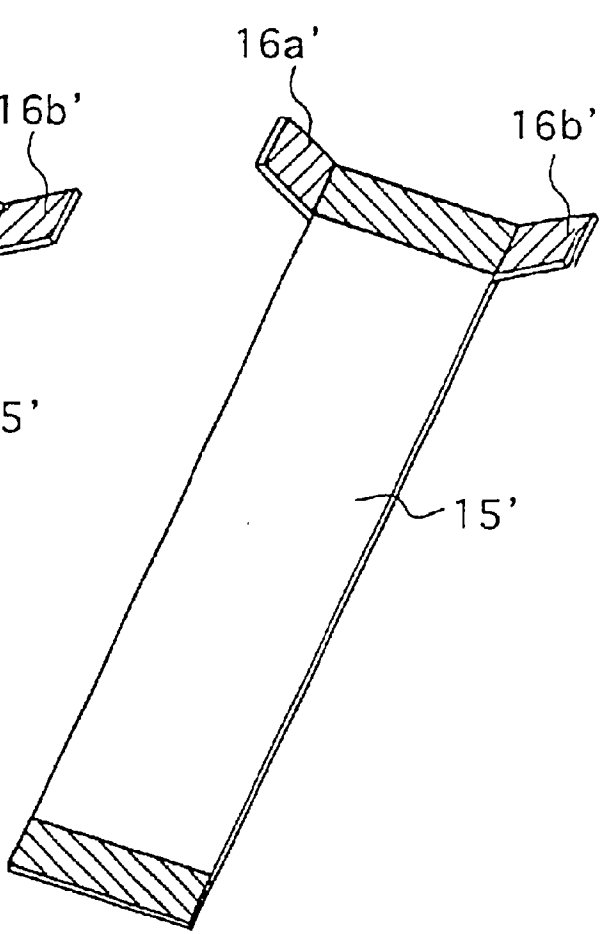
FIGS. 7A, 7B show structures of a MYLAR® related to the second embodiment of the present invention.
Figure 7A:
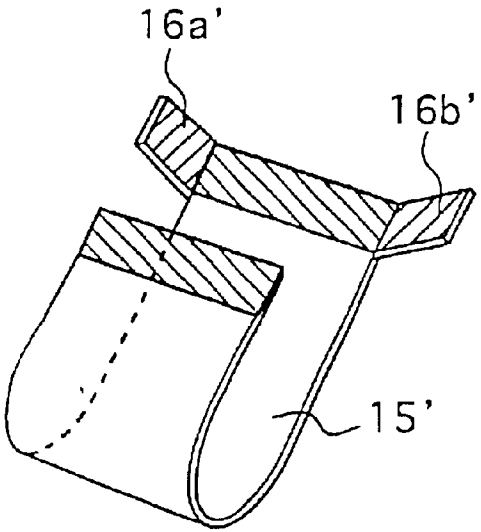
Figure 8A:
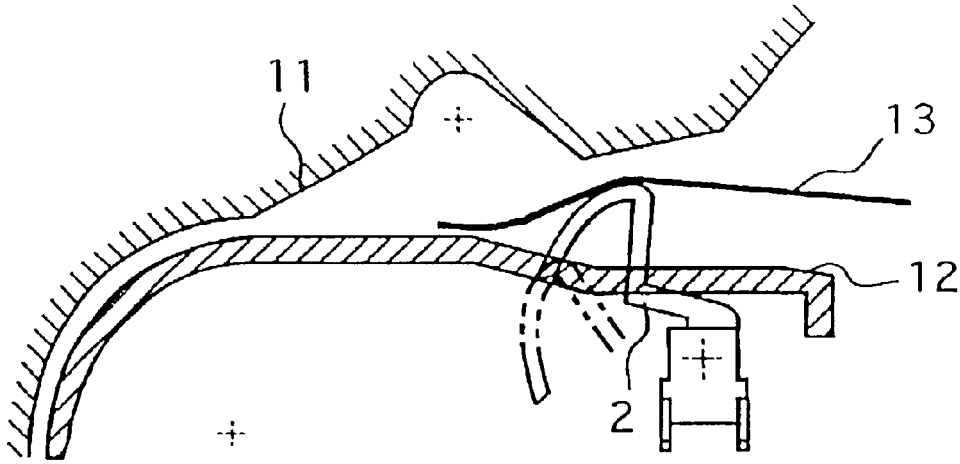
FIG. 8A(PRIOR ART)
FIGS. 8A, 8B show the operation of the conventional document-detecting sensor (with one sheet of document)
Figure 8B:
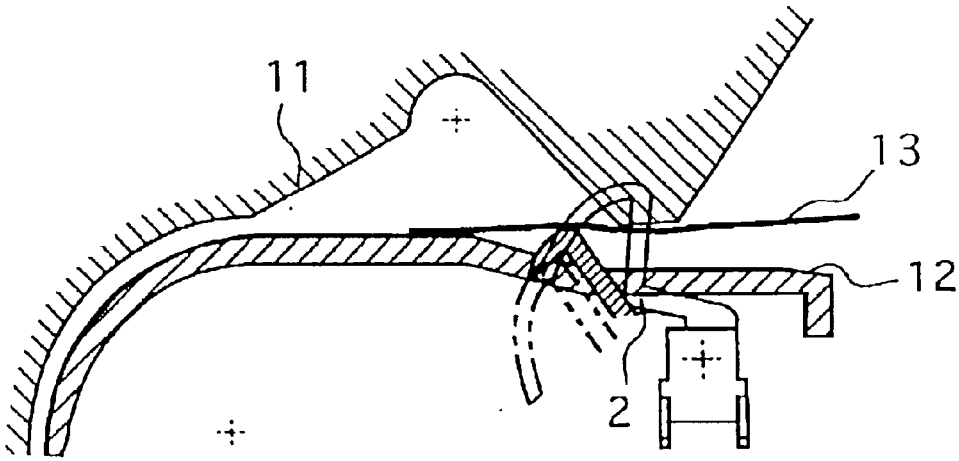
FIG. 8B(PRIOR ART)
Figure 9A:
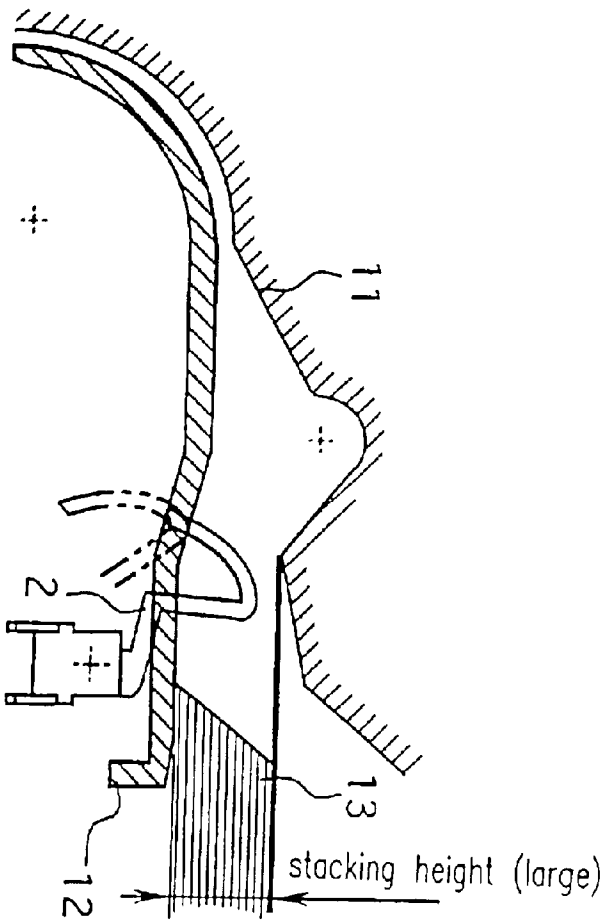
FIG. 9A(PRIOR ART)
FIGS. 9A, 9B show the operation of the conventional document-detecting sensor (with stacking sheets of document)
Figure 9B:
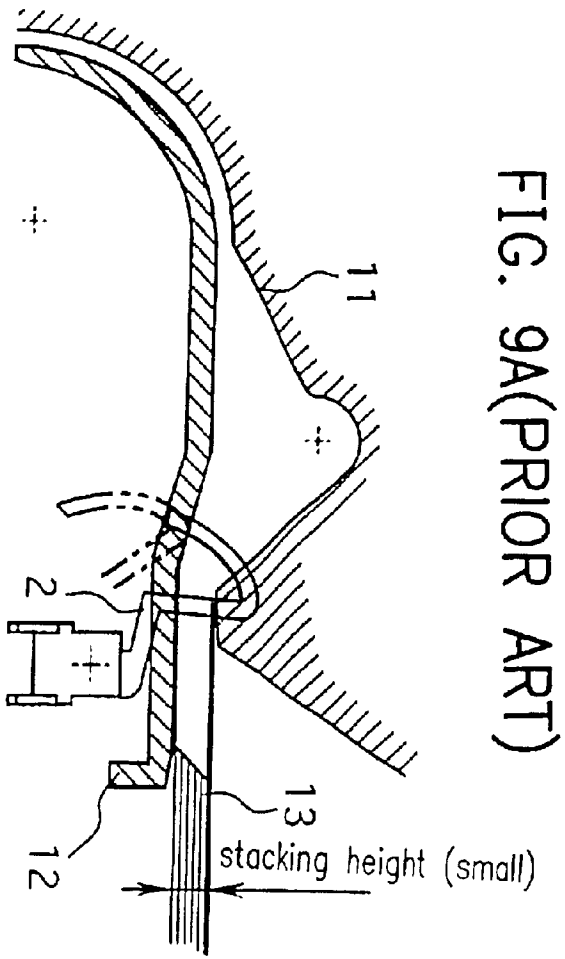
FIG. 9B(PRIOR ART)
Figure 10A:
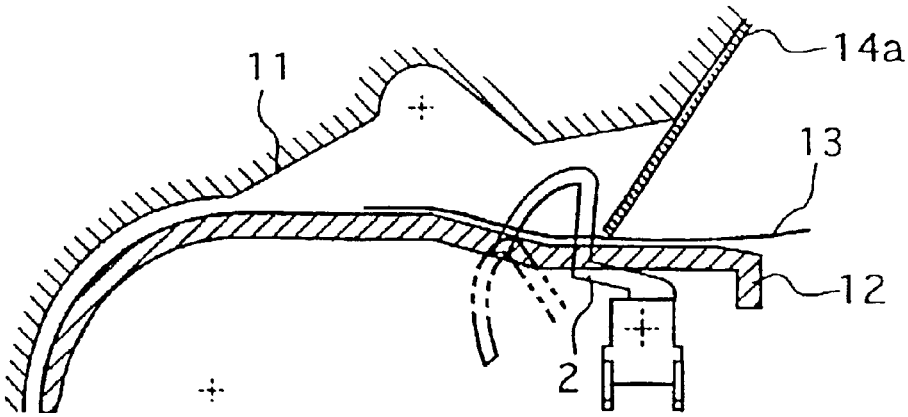
FIG. 10A(PRIOR ART)
FIGS. 10A, 10B show the operation of the conventional document-detecting sensor with a document guide set therein.
Figure 10B:
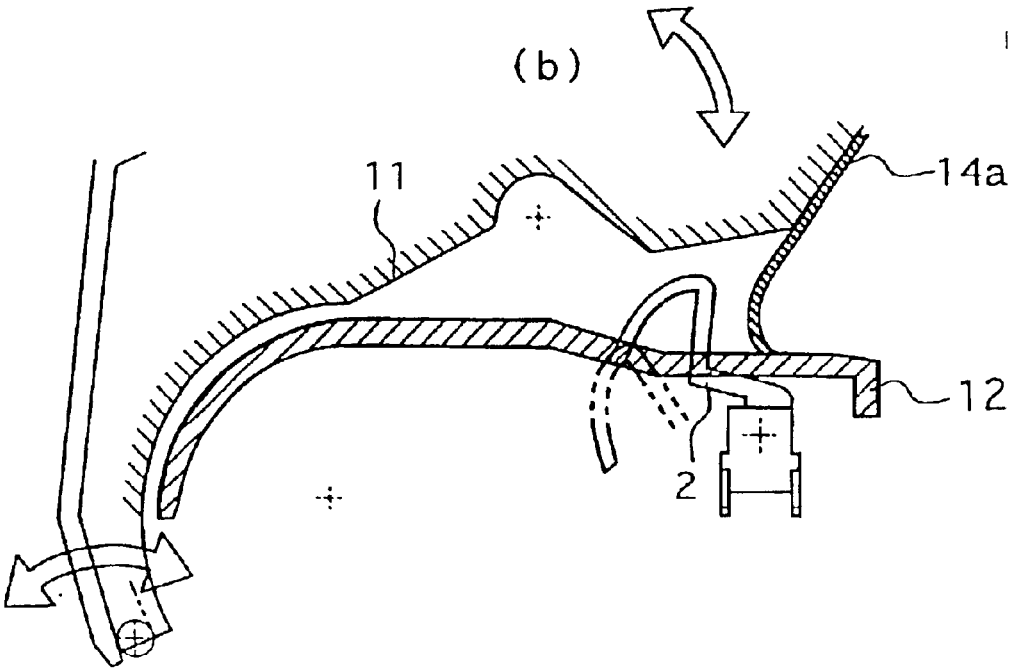
FIG. 10B(PRIOR ART)

Next, the installation of the MYLAR® 15' is explained with referring to FIGS. 7A and 7B As shown in FIG. 7B, the MYLAR® 15' has bending portions (bending claws) 16*a*', 16*b*'. For forming the loop shape, there is an adhesive or a bonding material on the adhesive locations (the oblique portions at two ends in longitudinal direction) and on the bending portions 16*a*', 16*b*' As a result, when the MYLAR® 15' is to be installed in the separation feeding portion of the ADF 50, first, two ends of the MYLAR® 15' are overlapped to adhere to each other to form a loop shape as shown in FIG. 7A. Second, the bending portions 16*a*', 16*b*' are bent to adhere onto the rib structure 21 of the upper guide plate 11. Here, the adhesive or the bonding material can be replaced by a two-face tape. In this way, because ear-shaped bending portions 16*a*', 16*b*' are set extending in longitudinal and vertical directions of the MYLAR® 15', the MYLAR® 15' can be prevented from becoming detached due to the contact with the inserted document 13 or the friction resulting from opening or closing the upper guide plate 11.

In each embodiment described above, the carrier plate is formed with the document tray 5 etc., the detecting means is formed with the document-detecting sensor 2 etc., the guide means is formed with the MYLAR® 15, 15' etc. and the bending claws are formed with bending portions 16*a*, 16*b*, 16*a*', 16*b*'.

Additionally, in each embodiment described above, though the document guide is explained as a MYLAR® with a loop shape, a pushing guide member made of plastic, or a rotatable roller can be used to achieve the same effects as the MYLAR®. For example, the pushing guide member has the same cross-sectional shape as the MYLAR® 15 as shown in FIG. 4 and is formed into a two-way shape to overlap the filler of the document-detecting sensor 2. The pushing guide member is rotatably supported onto the upper guide plate 11 by a supporting member such as a rotational shaft. With this structure, to keep the location where the pushing guide member touches the lower guide plate 12 from moving to the upstream side in the paper-feeding direction of the supporting position of the upper guide plate 11 during the opening or closing of the upper guide plate 11, a stopper is set to limit the rotation range of the pushing guide member. Moreover, the position that the pushing guide member touches the lower guide plate 12 is set at the upstream side of the detecting position of the document-detecting sensor 2 and at the downstream side in the paper-feeding direction of the supporting position of the upper guide plate 11. Moreover, for example, the roller is set to be rotatably supported onto the upper guide plate 11 by the supporting member such as a rotational shaft. The roller is rotatable at two ends of the two-way-shaped arm. The roller and the arm overlap the filler of the document-detecting sensor 2. The roller also can touch the lower guide plate 12 at center of the arm supporting position between the detecting position of the document-detecting sensor 2 and the upper guide plate 11. With this structure, to keep the location where the rotatable roller touches the lower guide plate 12 from moving to the upstream side in the paper-feeding direction of the arm supporting position of the upper guide plate 11, the stopper is set to limit the rotation range of the arm.

With the structure according to the present invention, since a part of the guide means (MYLAR® etc.) is in contact with the sheet carrying surface, even if the loaded sheets (document etc) are few, there is no gap existing at the front end of the MYLAR® due to the flexibility and resilience of the MYLAR®. The document can be prevented from returning to the upstream side in the paper-feeding direction due to the vibration during driving the device or due to the recovery force of the filler of the detecting means (document-detecting sensor etc.).

With the structure according to the present invention, a part of the loop formed onto the guide means (MYLAR® etc.) is in contact with the sheet carrying surface, so the sheet (document etc.) can be smoothly guided with respect to the detecting means (document-detecting sensor etc.), and then the shape of the MYLAR® can be stabilized to prevent it from being buckled.

With the structure according to the present invention, the filler of the detecting means (document-detecting sensor etc.) and the guide means (MYLAR® etc.) overlap each other when the document is not detected, so the MYLAR® and the filler can be prevented from interference, and the limitation of the layout can be eased to make the device slimmer.

With the structure according to the present invention, the bending claws (bending portions etc.) are set for installing the guide means (MYLAR® etc.) onto the upper guide plate, so the drawback that the MYLAR® with a loop shape is easily detached can be overcome.

With the structure according to the present invention, because the installation position of the guide means (MYLAR® etc.) is at the upstream side in the paper-feeding direction of the position such that the guide means is in contact with the sheet carrying surface, even if the sheet (document etc.) bends towards the front end of the loop due to the loop shape of the MYLAR® and its flexibility, the sheet can be guided towards the detecting position.

With the structure according to the present invention, because the paper feeding device is set in the sheet carrying device, the sheet (document etc.) which is set at the feeding start position can be detected no matter what the thickness of the paper or the number of the sheets of the document is.

While the present invention has been described with preferred embodiments, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A paper feeding device, comprising:

a carrier plate, for loading a sheet;

a detecting means, for detecting the sheet loaded on the carrier plate, and a guide means, made of a resilience member, wherein a part of the guide means is in contact with a sheet carrying surface at an upstream side of a detecting position of the detecting means, and the guide means guides the sheet towards the detecting position while the guide means is pushing an upper surface of the sheet, wherein the resilience member is bent into a loop shape, wherein the detecting means comprises a filler, protruding from the sheet carrying surface when the sheet is not detected and retroceding after the filler touches the sheet loaded in the carrier plate, and wherein the filler and the guide means overlap each other when the sheet is not detected and a hole is set in the loop shape of the guide means so that the filler and the guide means overlap each other as a result of the filler being inserted into the hole of the loon shape of the guide means.

2. The paper feeding device of claim 1, wherein the sheet carrying surface is in contact with a part of the loop shape.

3. The paper feeding device of claim 1, wherein bending claws are set at an end in a longitudinal direction of the guide means to install the guide means onto an upper guide plate oppositely set at an upper side of the sheet carrying surface.

4. The paper feeding device of claim 1, wherein an installation position of the guide means is at an upstream side in a paper-feeding direction of a position that the guide means is in contact with the sheet carrying surface.

5. The sheet carrying device of claim 1, wherein the hole set in the loop shape of the guide means is configured so that the filler may be inserted into the hole and thus the filler and the guide means overlap each other.

6. A sheet carrying device, comprising a paper feeding device, wherein the paper feeding device comprises:

a carrier plate, for loading a sheet;

a detecting means, for detecting the sheet loaded on the carrier plate; and a guide means, made of a resilience member, wherein a part of the guide means is in contact with a sheet carrying surface at an upstream side of a detecting position of the detecting means, and the guide means guides the sheet towards the detecting position while the guides means is pushing an upper surface of the sheet, wherein the resilience member is bent into a loop shape, wherein the detecting means comprises a filler, protruding from the sheet carrying surface when the sheet is not detected and retroceding after the filler touches the sheet loaded in the carrier plate, and wherein the filler and the guide means overlap each other when the sheet is not detected and a hole is set in the loop shape of the guide means so that the filler and the guide means overlap each other as a result of the filler being inserted into the hole of the loop shape of the guide means.

7. The sheet carrying device of claim 6, wherein the sheet carrying surface is in contact with a part of the loop shape.

8. The sheet carrying device of claim 6, wherein bending claws are set at an end in a longitudinal direction of the guide means to install the guide means onto an upper guide plate oppositely set at an upper side of the sheet carrying surface.

9. The sheet carrying device of claim 6, wherein an installation position of the guide means is at an upstream side in a paper-feeding direction of a position that the guide means is in contact with the sheet carrying surface.

10. The sheet carrying device of claim 6, wherein the hole set in the loop shape of the guide means is configured so that the filler may be inserted into the hole and thus the filler and the guide means overlap each other.

11. A paper feeding device, comprising:

a carrier plate for loading a sheet;

a detecting part, which detects the sheet loaded on the carrier plate; and a guide part, made of a resilience member, wherein a part of the guide part is in contact with a sheet carrying surface at an upstream side of a detecting position of the detecting part, and the guide part guides the sheet towards the detecting position while the guide part is pushing an upper surface of the sheet, wherein the resilience member is bent into a loop shape, wherein the detecting part comprises a filler, protruding from the sheet carrying surface when the sheet is not detected and retroceding after the filler touches the sheet loaded in the carrier plate, and wherein the filler and the guide part overlap each other when the sheet is not detected and a hole is set in the loop shape of the guide part so that the filler and the guide part overlap each other as a result of the filler being inserted into the hole of the loop shape of the guide part.

12. The paper feeding device of claim 11, wherein the sheet carrying surface is in contact with a part of the loop shape.

13. The paper feeding device of claim 11, wherein bending claws are set at an end in a longitudinal direction of the guide part to install the guide part onto an upper guide plate oppositely set at an upper side of the sheet carrying surface.

14. The paper feeding device of claim 11, wherein an installation position of the guide part is at an upstream side in a paper-feeding direction of a position that the guide part is in contact with the sheet carrying surface.

15. The sheet carrying device of claim 11, wherein the hole set in the loop shape of the guide part is configured so that the filler may be inserted into the hole and thus the filler and the guide part overlap each other.

16. A sheet carrying device, comprising:

a paper feeding device, wherein the paper feeding device comprises:

a carrier plate, for loading a sheet;

a detecting part detecting the sheet loaded on the carrier plate; and a guide part, made of a resilience member, wherein a part of the guide part is in contact with a sheet carrying surface at an upstream side of a detecting position of the detecting part, and the guide part guides the sheet towards the detecting position while the guides part is pushing an upper surface of the sheet, wherein the resilience member is bent into a loop shape, wherein the detecting part comprises a filler, protruding from the sheet carrying surface when the sheet is not detected and retroceding after the filler touches the sheet loaded in the carrier plate, and wherein the filler and the guide part overlap each other when the sheet is not detected and a hole is set in the loop shape of the guide part so that the filler and the guide part overlap each other as a result of the filler being inserted into the hole of the loop shape of the guide part.

17. The sheet carrying device of claim 16, wherein the sheet carrying surface is in contact with a part of the loop shape.

18. The sheet carrying device of claim 16, wherein bending claws are set at an end in a longitudinal direction of the guide part to install the guide part onto an upper guide plate oppositely set at an upper side of the sheet carrying surface.

19. The sheet carrying device of claim 16, wherein an installation position of the guide part is at an upstream side in a paper-feeding direction o£ a position that the guide part is in contact with the sheet carrying surface.

20. The sheet carrying device of claim 16, wherein the hole set in the loop shape of the guide part is configured so that the filler may be inserted into the hole and thus the filler and the guide part overlap each other.

* * * * *